US007036472B2

(12) United States Patent
Mencher et al.

(10) Patent No.: US 7,036,472 B2
(45) Date of Patent: May 2, 2006

(54) METHOD FOR DETERMINING THE PHASE POSITION OF AT LEAST ONE CAMSHAFT

(75) Inventors: Bernhard Mencher, Schwieberdingen (DE); Georg Mallebrein, Korntal-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/018,518

(22) Filed: Dec. 20, 2004

(65) Prior Publication Data

US 2005/0155565 A1 Jul. 21, 2005

(30) Foreign Application Priority Data

Dec. 20, 2003 (DE) ..... 103 60 333

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS

2002/0096134 A1* 7/2002 Michelini et al. ..... 123/90.15

FOREIGN PATENT DOCUMENTS

DE 40 28 442 3/1992

* cited by examiner

*Primary Examiner*—Thomas Denion
*Assistant Examiner*—Zelalem Eshete
(74) *Attorney, Agent, or Firm*—Kenyon & Kenyon LLP

(57) ABSTRACT

A method for determining the phase position of at least one camshaft of an internal combustion engine, the phase position for at least one camshaft being determined on the basis of operating variables of the air system.

8 Claims, 3 Drawing Sheets

METHOD FOR DETERMINING THE PHASE POSITION OF AT LEAST ONE CAMSHAFT

FIELD OF THE INVENTION

The invention proceeds from a method for determining the phase position of at least one camshaft in an internal combustion engine.

BACKGROUND INFORMATION modern internal combustion engines increasingly have adjustable-phase camshafts. This makes possible variable control of intake and exhaust valves, and allows the combustion chamber charge to be maximized over a wide rotation speed range of the internal combustion engine, more power being attained as compared with ordinary systems, with favorable emissions values. At the same time, residual gas can be controlled over a wide range by way of a valve control system, so that in some cases an external EGR valve can be omitted.

For reliable operation of the valves and the ignition, fuel metering, and other systems, it is necessary to know the exact phase position of the camshafts with respect to the crank mechanism. Even a small offset in phase position, caused e.g. by incorrect installation of the toothed belt or by a tooth jump, results in incorrect mixture control and mismatched ignition angles. An incorrectly installed phase sensor or phase transmitter wheel can also cause the camshafts to be regulated to an incorrect phase position. A phase position offset of this kind not only endangers the internal combustion engine, e.g. because of a possible piston-valve collision, but also, in particular, results in a considerable increase in pollutant emissions. In order to limit pollutant emissions, certain authorities, for example the California Air Resources Board (CARB), therefore require that the camshaft phase positions must be diagnosed and, if applicable, controlled, and that the fault be indicated.

For phase position diagnosis, a method is known from German Published Patent Application No. 40 28 442 in which a rotation speed sensor is disposed on the crankshaft and a phase sensor on the camshaft. The phase position of the camshaft is determined by way of the evaluated sensor signals.

Also known are methods that, with the camshaft phase positioner in a predefined rest position, determine the phase position of the camshaft with respect to the phase position of the crankshaft, and then correct installation tolerances of the phase positioner as applicable.

It has been found in practice, however, that the angular tolerances upon installation of the phase transmitter and the angular tolerances of the rest position of the phase positioner can be quite large. For a camshaft, an installation phase tolerance of 3 to 5° with reference to the camshaft is entirely possible. If phase shifts occur within this tolerance range, for example in the context of a one-tooth offset of a toothed belt, that offset cannot reliably be detected.

The method according to the present invention for determining the phase position of a camshaft of an internal combustion engine, having the features of the independent main claim, has, in contrast, the advantage that the phase position is identified on the basis of operating variables of the air system, and therefore independently of tolerances of a camshaft transmitter wheel or camshaft sensor. In addition, variables originally affected by the incorrect sensing—e.g. the fresh air charge and/or residual gas charge—are directly diagnosed with the method according to the present invention.

It is particularly advantageous that the phase position of the camshaft is identified at at least one operating point with constant rotation speed demand and load demand, thereby improving the reliability with which the phase position is determined. According to a further advantageous refinement, expected operating variables are present for at least one phase position, operating variables of the air system being identified in the at least one phase position at at least one operating point with constant rotation speed demand and load demand, the identified operating variables being compared with the operating variables to be expected in the present phase position, and an incorrectly sensed phase position being inferred in the event of deviations that exceed a limit value.

In a further advantageous embodiment, at least one camshaft is brought into at least two different phase positions, operating variables of the air system being identified, for each phase position that is set, at at least one operating point with a constant rotation speed demand and load demand.

According to a further advantageous refinement, for at least two phase positions, the difference between the operating variables identified in the various phase positions is calculated and is compared with an expected difference. A deviation of the identified difference from the expected difference is ascertained and is compared with a limit value. If the ascertained deviation exceeds that limit value, an erroneously sensed phase position is inferred. By calculating differences it is possible to eliminate systematic errors, for example an offset, thereby advantageously making the diagnosis of phase position more reliable.

According to a further advantageous embodiment, once an erroneously sensed phase position has been detected, the sensing of the phase position or of the camshaft angle is adaptively corrected. This has the advantage that the internal combustion can at first continue to be operated without significant impairment.

According to a further advantageous embodiment, an error message is compulsorily issued, for example to the driver, when the erroneously detected phase position can no longer be adaptively corrected according to predetermined criteria and, for example, target positions of the camshafts can no longer be reached. This has the advantage that larger corrections, which are no longer neutral in terms of operation of the internal combustion engine or, in extreme cases, could result in damage to the engine (piston-valve collision), are signaled in timely fashion.

Further features, potential applications, and advantages of the invention are evident from the description below of exemplifying embodiments of the invention that are depicted in the drawings. All features described or depicted, of themselves or in any combination, constitute the subject matter of the invention, irrespective of their grouping in the claims or their internal references, and irrespective of their presentation and depiction in the description and the claims, respectively.

DETAILED DESCRIPTION

Figure 1:
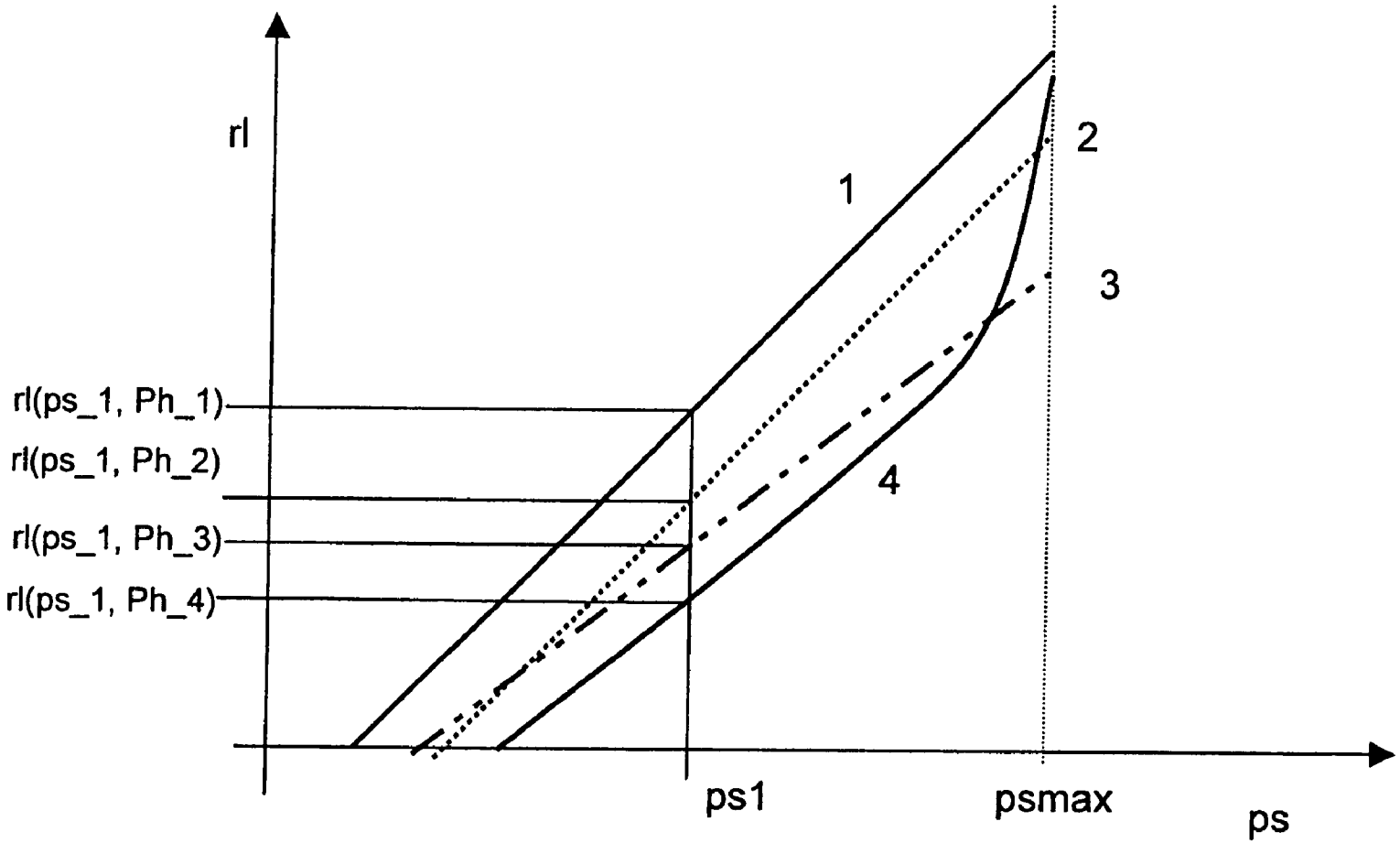
FIG. 1 shows a diagram showing the correlation between intake duct pressure ps and fresh air charge in the combustion chamber r1 at various phase positions of the camshaft.

FIG. 1 is a diagram plotting the mass of the fresh air charge in the combustion chamber r1 against intake duct pressure ps for various phase positions Ph of the intake and exhaust camshafts, the curves being limited by the maximum intake duct pressure psmax.

The solid-line curve labeled with the number 1 represents the profile of the fresh air charge at a small valve overlap and a phase position Ph_1 at which practically no back-suction of residual gas out of the exhaust system through the combustion chamber into the intake system is present; the closing angle of the exhaust valve is such that the residual gas charge remaining in the combustion chamber is minimal, and the intake valve closing angle that is present is one at which a maximum total charge in the combustion chamber is achieved.

The dotted curve labeled with the number 2 represents the profile of the fresh air charge at a similarly small valve overlap but at a phase position Ph_2 at which more residual gas remains in the combustion chamber because the exhaust valve closes too early or too late, resulting in an offset of curve 2 downward and parallel to curve 1. The intake valve closing angle that is present is still one at which a maximum total charge in the combustion chamber is achieved.

The dot-dash curve labeled with the number 3 represents the profile of the fresh air charge at a similarly small valve overlap and a phase position Ph_3 at which an intake valve closing angle is present at which the total charge in the combustion chamber is reduced. The reduced total charge is apparent from the decreased slope of the curve.

The solid-line bent curve labeled with the number 4 represents the profile of the fresh air charge at maximum valve overlap and a phase position Ph_4 at which a considerable back-suction of residual gas is present, the intake valve closing angle being such that a maximum total charge in the combustion chamber is present. In principle, the curves are linear for a small valve overlap, the slope being defined substantially by the closing angle of the intake valve. With increasing valve overlap, the correlation between fresh air charge and intake duct pressure transitions into a nonlinear behavior; as before, at low intake duct pressures the slope depends on the closing angle of the intake valve.

The fresh air charge can thus be represented as a function of the intake duct pressure and the phase positions:

r1=f(ps, Ph_i), the function values being determined, for example, by measurements on the internal combustion engine or on a comparison internal combustion engine under known and controllable operating conditions, and stored in tables or characteristics diagrams. In addition, it is also conceivable to determine these function values by calculations or simulations.

According to the present invention it is now possible, because of the known dependences of the fresh air charge on the intake duct pressure and on the phase positions, to infer a phase position of the camshafts of the internal combustion engine solely on the basis of operating variables of the air system. The operating variables of the air system that are to be identified are to be understood in this context as at least the mass of the fresh air charge in the combustion chamber r1 and the intake duct pressure ps, although other operating variables of the air system that either exhibit a separate correlation with the phase positions or can be converted into known variables are also conceivable.

Alternatively or additionally, further operating variables that do not belong directly to the air system can/must be employed, for example the intake air temperature.

According to the present invention, as further depicted in FIG. 1, for a specific intake duct pressure ps1 a present fresh air charge r1(ps_1, Ph_i) is identified. An operating point of the internal combustion engine at which a constant rotation speed demand and load demand exist is preferably selected for the measurement, so that substantially steady-state conditions are also present during the measurement. One preferred operating point is idle speed, although other operating points with substantially steady-state operating conditions can also be selected or arrived at in controlled fashion. As depicted in FIG. 1, for a specific intake duct pressure ps1, different fresh air charges r1(ps_1, Ph_i), i=1, 2, 3, 4 occur at different phase positions Ph_i.

This procedure has the advantage that signals and/or data already available in the system can be utilized, with no need for additional sensor equipment.

Figure 2:
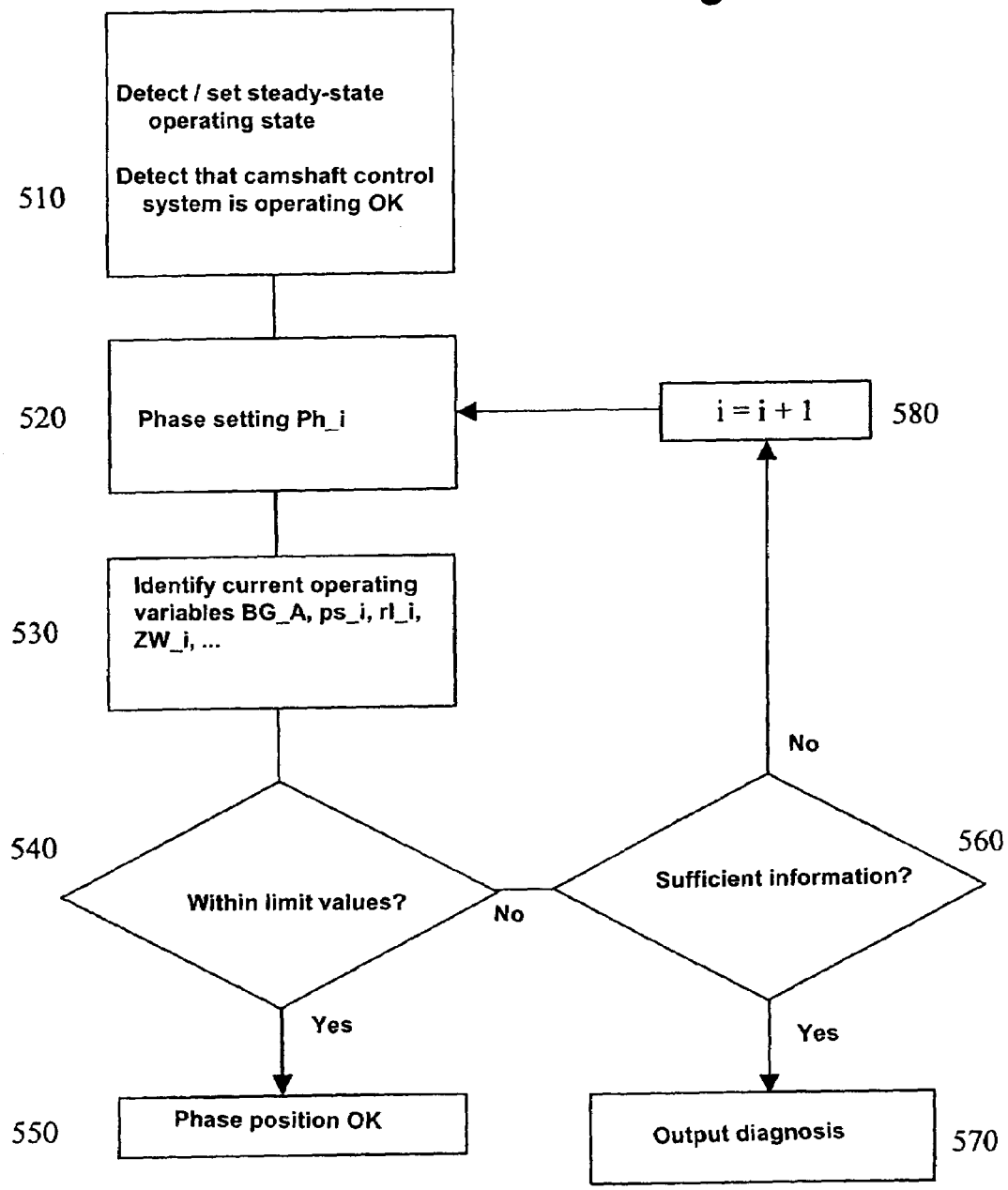
FIG. 2 shows a flow chart of the method according to the present invention.

FIG. 2 shows a method according to the present invention for determining the phase positions of camshafts, in which in a first step 510 a present steady-state operating state either is detected or is deliberately set, and furthermore a check is made as to whether the phase control system of the camshafts is functioning correctly. In the next step 520, the target phase positions either are already known or are deliberately set by way of a measurement routine or other parameters. In the next step 530 the current operating variables BG_A of the air system, for example the fresh air charge r1_i, intake duct pressure psi, and/or also further operating variables such as, for example, the intake air temperature or an ignition angle ZW_i, are then identified. In a further step 540 the identified operating variables BG_A are compared with the operating variables BG_E, stored e.g. in characteristics diagrams or tables, that are to be expected in the present phase positions. If the absolute value of the deviations is less than a limit value |BG_A−BG_E|21 LV, then in a step 550 the phase position is reported as being error-free. If at least one deviation exceeds its respective limit value, a step 560 checks whether the measured and obtained data are sufficient to allow an erroneous phase position of a camshaft to be unequivocally inferred. The data are not sufficient, for example, if the limit value was only slightly exceeded, if the current measured operating variables indicate an operating point of the internal combustion engine that is steady-state but not necessarily stable over the long term, or if only a single measurement is available. If the data are deemed sufficient, the phase position is reported as erroneous in a step 570. If the data are deemed insufficient, then in a step 580 new parameters are defined for a phase setting in step 520. The parameters from step 580 can consist in the fact that from a predefined number of phase positions, the next phase positions of the intake and exhaust camshafts are selected in an incrementing step, or suitable phase positions for a new measurement are selected on the basis of other parameters. The method steps are continued either until sufficient data are present and the phase positions are recognized to be error-free, or until a termination criterion is reached.

In a further preferred embodiment, in addition or alternatively to the individual current operating variables, the differences between the currently measured operating values are also considered in step 540. For this, corresponding operating variables BG_A(Ph_i) must be present for at least two different phase settings Ph_i. Different phase positions lead to different operating variables, especially to a difference in charge variables, e.g. the intake duct pressure ps. The current difference $\Delta A_ps_i,j=|BA_A(ps_i)-BG_A(ps_j)|$ is compared with an expected difference $\Delta E_{13}i,j$; i, j=1, 2, 3, . . . , and i≠j, and a deviation $\delta\Delta ps_i,j=|\Delta A_ps_i,j-\Delta E_ps_{13}\ i,j|$ is determined. If the deviation $\delta\Delta ps_i,j$ remains below a corresponding limit value, the phase position is then reported as error-free in a step 550; if the limit value is exceeded, execution continues in step 560. This procedure has the particular advantage that because the differences are calculated, systematic errors (such as an offset) do not influence the diagnosis of the phase position. Instead of the differences between intake duct pressures, other charge variables or operating variables influenced by the camshaft positions can also be adopted.

Figure 3:
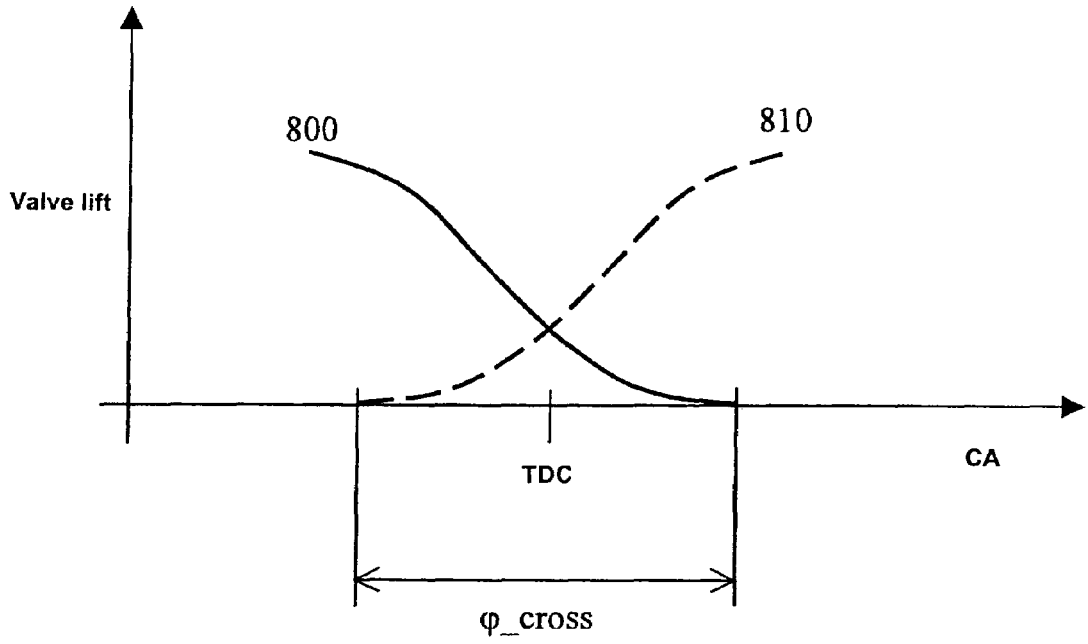
FIG. 3 shows a diagram showing valve lift as a function of crankshaft angle with a valve overlap.

In a further exemplifying embodiment that is not depicted, further steady-state operating states can be set in addition to the different settings of the phase position. The reliability with which the phase position of the camshafts is sensed can thus be further enhanced by identifying further operating variables under different conditions. In a further exemplifying embodiment, provision is made to check the phase position for plausibility on the basis of a known relationship between the intake duct pressure ps and the valve overlap angle. FIG. 3 depicts, by way of example, the valve lift values as a function of the crankshaft angle CA, solid-line curve 800 schematically depicting the lift profile of the exhaust valve and dashed curve 810 the lift profile of the intake valve. If the intake valve opens before the exhaust valve closes, a valve overlap exists, the crankshaft angle elapsing between the opening of the intake valve and closing of the exhaust valve being referred to as the overlap angle ν_cross. Although the overlap region shown in FIG. 3 is symmetrical about a top dead center point of the piston motion, other overlap regions (in particular asymmetrical ones) are nevertheless also possible.

Figure 4:
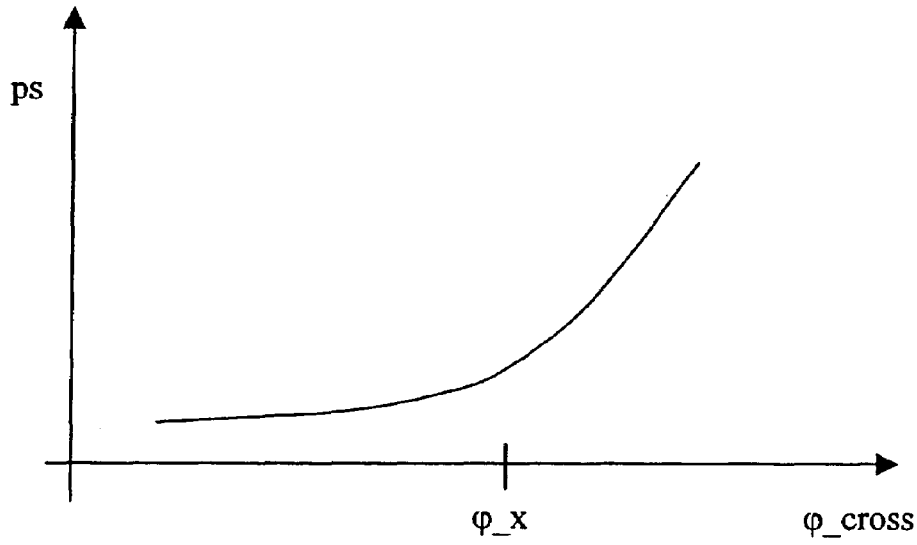
FIG. 4 shows a diagram showing the change in intake duct pressure ps as a function of valve overlap.

FIG. 4 schematically depicts the dependence of intake duct pressure ps on the overlap angle ϕ_cross, the valve overlap being dependent on the positions of the camshaft and in particular on the intake-closed angle. As the overlap angle ϕ_cross increases, the intake duct pressure ps also increases, rising more and more steeply beyond a specific overlap angle ϕ_x. It is known that beyond a specific overlap angle the residual gas in the intake duct increases greatly, for example at idle. In principle, the pressure of the residual gas before the intake valve opens and the exhaust valve closes is approximately equal to the exhaust gas counterpressure, and is therefore higher than the intake duct pressure at part load. When the intake valve opens, that pressure is relieved and the residual gas flows into the intake duct. If a valve overlap is additionally present, not only the depressurizing residual gas that originally filled the upper dead space of the combustion chamber, but also the residual gas from the exhaust system, flows through the two open valves into the intake duct. In the subsequent intake phase, this residual gas flows back into the combustion chamber.

If the mass flow flowing through a throttle valve is then compared with the measured intake duct pressure ps, the intake duct pressure ps rises sharply beyond a specific overlap angle ϕ_x. The exact value of this overlap angle ϕ_x can be identified, for example, by way of a difference method, preferably in the application phase, and for many applications is equal to approximately 10 degrees of overlap.

If the overlap angle ϕ_x, and therefore the rising slope characteristic of the intake duct pressure, is known, the possibility thus exists of setting different overlap angles (e.g. by varying the phase positions of both camshafts) and of determining, by way of the measured intake duct pressure ps, the value of the overlap angle ϕ_x above which the residual gas charge sharply increases.

The position of the intake camshaft alone can be determined, for example in a context of very little or no camshaft overlap, by varying the closing angle of the intake camshaft. The intake camshaft is preferably varied in a range in which a large influence on the conversion factor (fuprs1)—conversion of intake duct pressure ps to cylinder charge r1—may be expected. A plausibility check of the phase position of the intake camshaft can then be performed in this fashion. Based on the known phase position of a camshaft (the intake camshaft, in this example) at the known overlap, the phase position of the other camshaft (in this case the exhaust camshaft) can be inferred. It is thereby possible to check the plausibility of the phase signals of the phase transmitters for both camshafts.

A further advantageous expression is an adaptation of the angular error of the camshaft, so as to ascertain that angular offset e.g. when the tooth offset is known, and thereby to correct the phase position. The camshaft control system can thus control the camshaft back to the "correct" target values within a wide range, and the internal combustion engine can be kept safely in the desired operating mode with no significant impairments in terms of e.g. output or emissions.

Only when so many phase jumps have occurred that the adjustment range of the camshaft is significantly limited, and there is a risk of operating impairments or in fact engine damage cannot be ruled out (piston-valve collision), is it then imperative for an error message or fault light to be activated. The criteria beyond which adaptive correction is no longer reasonably possible can be predetermined a priori, for example by experiment or simulation. The degree to which the adjustment range of the camshafts is limited can be defined, for example, as a criterion for a maximum tolerable phase shift.

What is claimed is:

1. A method for determining a phase position of at least one camshaft of an internal combustion engine, comprising:

determining the phase position for the at least one camshaft on the basis of operating variables of an air system;

providing operating variables to be expected for at least one phase position;

identifying the operating variables of the air system in the at least one phase position at at least one operating point with constant rotation speed demand and load demand;

comparing the identified operating variables with the operating variables to be expected in a present phase position of the at least one phase position;

identifying a deviation for each compared operating variable; and inferring an incorrectly sensed phase position as soon as the identified deviation exceeds a respective limit value.

2. The method as recited in claim 1, wherein the phase position of the at least one camshaft is determined at at least one operating point with constant rotation speed demand and load demand.

3. The method as recited in claim 1, further comprising:

bringing the at least one camshaft into at least two different phase positions, operating variables of the air system being identified, for each phase position that is set, at at least one operating point with constant rotation speed demand and load demand.

4. The method as recited in claim 3, further comprising:

calculating, for at least two phase positions, a difference between the identified operating variables;

ascertaining a deviation from an expected difference; and if the ascertained deviation exceeds a limit value, inferring an erroneously sensed phase position.

5. The method as recited in claim 1, wherein:

the operating variables of the air system include a fresh air charge in a combustion chamber and an intake duct pressure.

6. The method as recited in claim 1, further comprising:

employing further operating variables for determining the phase position, wherein the further variables include at least one of an intake air temperature and an ignition angle.

7. The method as recited in claim 1, further comprising:

upon detection of an incorrectly sensed phase position, adaptively correcting the sensing of the phase position.

8. The method as recited in claim 7, wherein as soon as the incorrectly sensed phase position can no longer be adaptively corrected according to predetermined criteria, an error message occurs.

* * * * *

UNITED STATES PATENT AND TRADEMARK OFFICE

CERTIFICATE OF CORRECTION

PATENT NO. : 7,036,472 B2
APPLICATION NO. : 11/018518
DATED : May 2, 2006
INVENTOR(S) : Mencher et al.

It is certified that error appears in the above-identified patent and that said Letters Patent is hereby corrected as shown below:

Column 5, line 3, change "…(ps_$_j$)|" to --…(ps_J)|--

Column 5, line 4, change "$\Delta E_{13}$i,j;" to -- ΔE_i,j;--

Column 5, line 6, change "ΔE_ps$_{13}$i,j|" to -- ΔE_ps_i,j|--

Signed and Sealed this

Nineteenth Day of December, 2006

JON W. DUDAS
*Director of the United States Patent and Trademark Office*